US007506661B2

(12) United States Patent
Corrigan et al.

(10) Patent No.: US 7,506,661 B2
(45) Date of Patent: Mar. 24, 2009

(54) STORAGE DEVICES FOR PORTABLE COMPRESSORS

(75) Inventors: Christian Corrigan, Bethlehem, PA (US); Theodore Flatt, Sherrills Ford, NC (US); William Roger Hutchinson, Clemmons, NC (US); William Keaton, Yadkinville, NC (US); David Franklin Rowe, Jr., Advance, NC (US); David B. Stahlman, Mooresville, NC (US); Charles Swartz, Mocksville, NC (US)

(73) Assignee: Doosan International USA, Inc., Statesville, NC (US)

( * ) Notice: Subject to any disclaimer, the term of this patent is extended or adjusted under 35 U.S.C. 154(b) by 0 days.

(21) Appl. No.: 11/571,054

(22) PCT Filed: Jun. 28, 2005

(86) PCT No.: PCT/US2005/022668

§ 371 (c)(1),
(2), (4) Date: Dec. 21, 2006

(87) PCT Pub. No.: WO2006/004631

PCT Pub. Date: Jan. 12, 2006

(65) Prior Publication Data

US 2007/0176038 A1 Aug. 2, 2007

Related U.S. Application Data

(60) Provisional application No. 60/583,884, filed on Jun. 29, 2004.

(51) Int. Cl.
*B65H 75/28* (2006.01)

(52) U.S. Cl. ..... 137/355.16; 137/355.12; 137/899.4; 242/400.1; 242/580

(58) Field of Classification Search ..... 137/355.12, 137/355.16, 355.28, 899.4; 239/195; 242/400, 242/400.1, 402, 570, 580, 586.4, 587.2, 587.3
See application file for complete search history.

(56) References Cited

U.S. PATENT DOCUMENTS

| | | | | | |
|---|---|---|---|---|---|
| 286,046 | A | | 10/1883 | McGaffey | |
| 357,900 | A | * | 2/1887 | Boyle | 248/89 |
| 1,532,177 | A | * | 4/1925 | Gist | 248/89 |
| 1,663,410 | A | * | 3/1928 | Larson et al. | 242/388.5 |
| 1,787,194 | A | * | 12/1930 | Freeth | 242/402 |
| 2,037,830 | A | | 4/1936 | Staley | |
| 2,334,141 | A | * | 11/1943 | Zierden | 137/355.28 |
| 2,438,306 | A | | 3/1948 | Souther | |
| 2,685,404 | A | | 8/1954 | Wohlmeyer | |
| 3,815,965 | A | | 6/1974 | Ostwald | |
| 4,022,550 | A | | 5/1977 | Brink et al. | |
| 4,759,560 | A | | 7/1988 | Virgulti | |

(Continued)

*Primary Examiner*—John Fox
(74) *Attorney, Agent, or Firm*—Michael Best & Friedrich LLP

(57) ABSTRACT

Apparatus for storing a hose or tools on a portable compressor. One embodiment of a hose storage device includes a support bar, a securing plate, and a locking bar. Another embodiment of a hose storage device includes a bracket, a hose reel, and a roller plate having a hose opening and at least one roller. One embodiment of a tool storage device includes a support structure having a top surface, a side surface, and a bottom surface. The tool storage device also includes a foam layer positioned between the top surface and the bottom surface.

10 Claims, 4 Drawing Sheets

U.S. PATENT DOCUMENTS 4,844,701 A 7/1989 Wolford et al.
5,027,478 A * 7/1991 Suhr ..... 24/16 R
5,309,604 A * 5/1994 Poulsen ..... 24/16 R
5,518,262 A 5/1996 Hutchinson et al.
5,980,217 A 11/1999 Swartz et al.
6,164,582 A * 12/2000 Vara ..... 242/395
6,168,054 B1 1/2001 Shelton, Jr.
6,203,287 B1 3/2001 Hendrix et al.
6,234,409 B1 5/2001 Aslakson

* cited by examiner

STORAGE DEVICES FOR PORTABLE COMPRESSORS

RELATED APPLICATION DATA

This application is a National Stage filing under 35 U.S.C. §371 of co-pending International Patent Application No. PCT/US2005/022668, filed Jun. 28, 2005, which further claims priority to U.S. Provisional Patent Application No. 60/583,884, filed Jun. 29, 2004, both of which are fully incorporated herein by reference.

FIELD OF THE INVENTION

The invention generally relates to portable compressor systems. More particularly, the invention relates to storage devices for portable compressor systems.

BACKGROUND OF THE INVENTION

Portable compressors generally include a frame structure supported on wheels. The frame structure supports a housing and has a cover that can be operated to access the inside of the housing. The housing supports a compressor system which provides high pressure air from a port that can be inside of outside the housing. To supply the high pressure air to a desired location, a hose is provided for connection to the discharge port.

SUMMARY OF THE INVENTION

It is desirable to provide storage devices for the hose and other tools that may be used with the portable compressor in a convenient, yet secure manner on board the portable compressor, so that the hose or tools are readily available.

Some embodiments of the invention provide a storage device for storing a hose on a portable compressor. The storage device includes a support bar around which the hose can be wrapped and a securing plate coupled to the support bar. The securing plate includes at least one first hose-receiving opening. A locking bar is coupled to at least one of the securing plate and the support bar. The locking bar is movable between an open position in which the hose can be unwrapped from the support bar and a closed position in which the hose is locked with respect to the at least one hose-receiving opening.

Another embodiment of the invention provides a storage device for storage a hose on a portable compressor that includes a frame and a housing. The storage device includes a bracket coupled to the frame inside the housing and a hose reel coupled to the bracket. The hose is wound around the hose reel. The storage device also includes a roller plate having a hose opening and at least one roller. The hose opening receives the hose and the at least one roller allowing the hose to move smoothly.

Other embodiments of the invention provide a storage device for storing at least one tool on a portable compressor. The storage device includes a support structure including a top surface, a side surface, and a bottom surface. The side surface includes at least one mounting hole, the top surface includes at least one first tool-receiving hole, and the bottom surface includes at least one second tool-receiving hole. The storage device also includes a foam layer positioned between the top surface and the bottom surface. The foal layer includes at least one slit aligned with the at least one first tool-receiving hole and the at least one second tool-receiving hole.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The illustrated embodiments will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting the invention.

Figure 1:
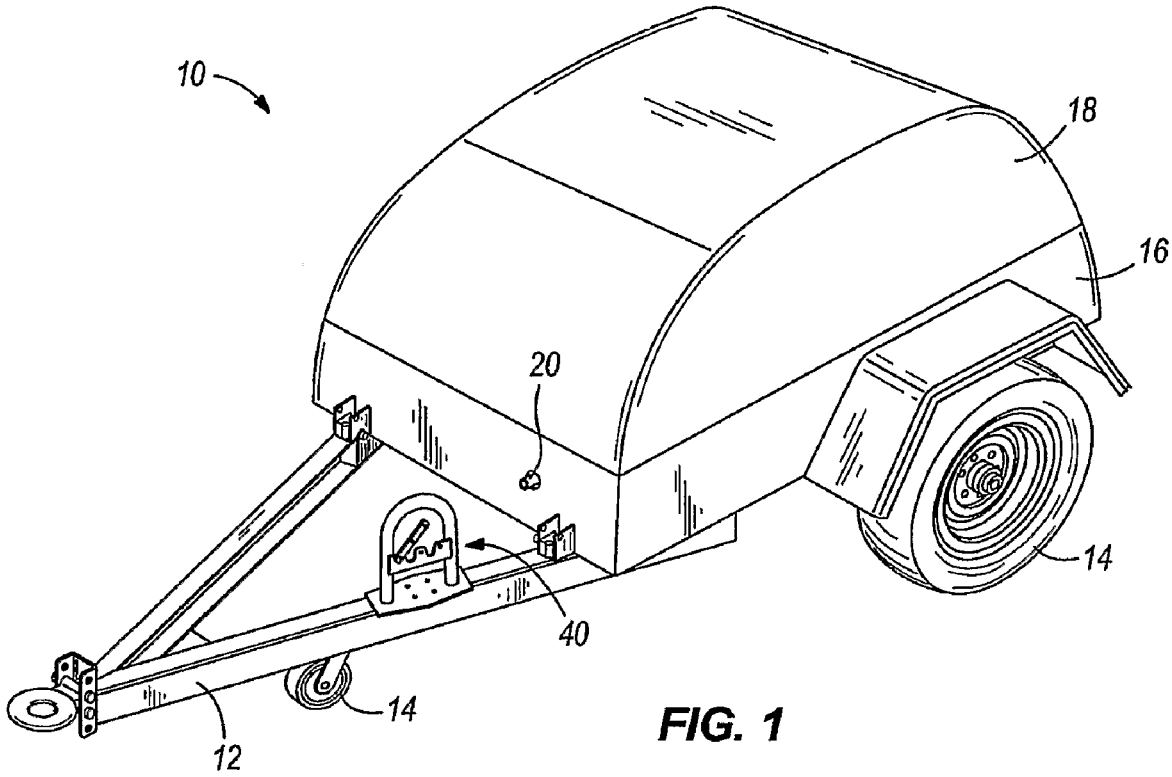
FIG. 1 is a perspective view of a portable compressor including a hose storage device according to one embodiment of the invention.
Figure 2:
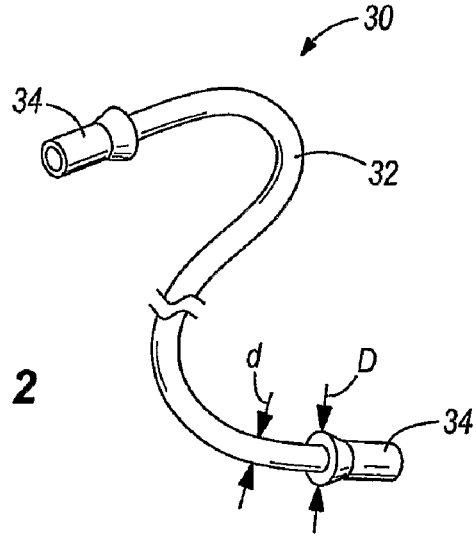
FIG. 2 is a perspective view of a hose for use with the hose storage device of FIG. 1.

FIG. 1 illustrates a portable compressor 10 including a frame structure 12, wheels 14, a housing 16, a cover 18, a compressor system (not shown), and a port 20. The housing 16 is supported by the frame structure 12. The cover 18 can be opened to access the inside of the housing 16. The compressor system is located inside the housing 16 and provides high pressure air from the port 20. FIG. 2 illustrates a hose 30 that can be connected to the port 20 to provide the high pressure air to a desired location. The hose 30 includes a tube portion 32 and end fittings 34.

Figure 3:
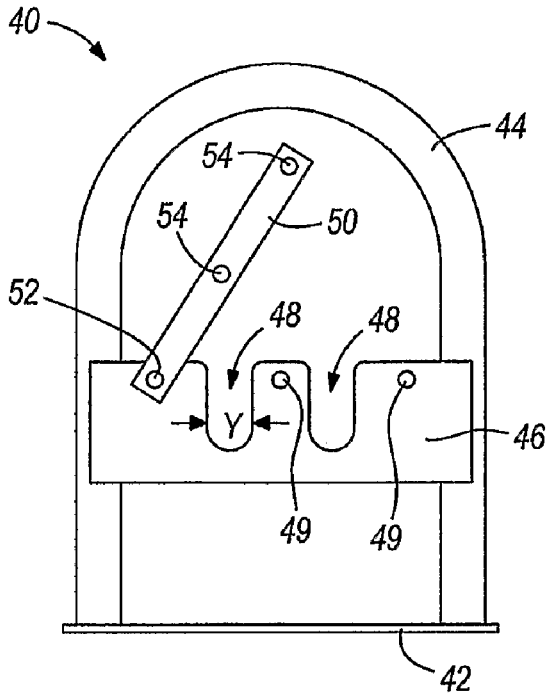
FIG. 3 is a front plan view of the hose storage device of FIG. 1 with a locking bar in an open position.
Figure 4:
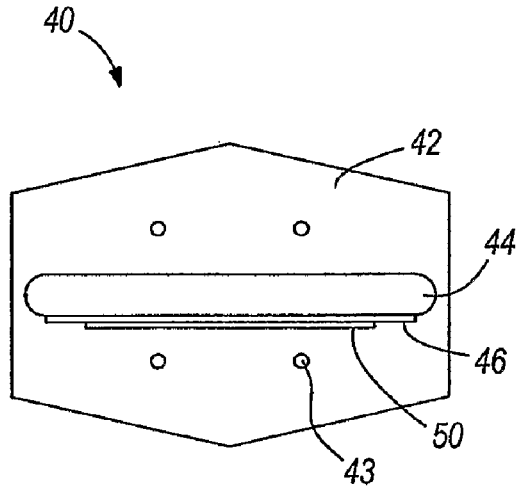
FIG. 4 is a top plan view of the hose storage device of FIG. 1.

FIGS. 1 and 3-6 illustrate a hose storage device 40 according to one embodiment of the invention. The hose storage device 40 includes a base plate 42 and a support post 44 attached to the base plate 42. In some embodiments, the base plate 42 and the support plate 44 are constructed of steel. The base plate 42 is configured for attachment to a portion of the portable compressor 10, such as to a drawbar portion of the frame 12, as shown in FIG. 1. As shown in FIG. 4, the base plate 42 may be provided with bolt holes 43 to facilitate attachment to the portable compressor 10. The support post 44 is configured to have the hose 30 wrapped around it, as shown in dashed lines in FIG. 6. The support post 44 is shown having a U-shaped configuration (i.e., a 180-degree loop), but it may have other shape configurations, such as a rectangular shape, a square shape with recesses on each side, etc.

Figure 5:
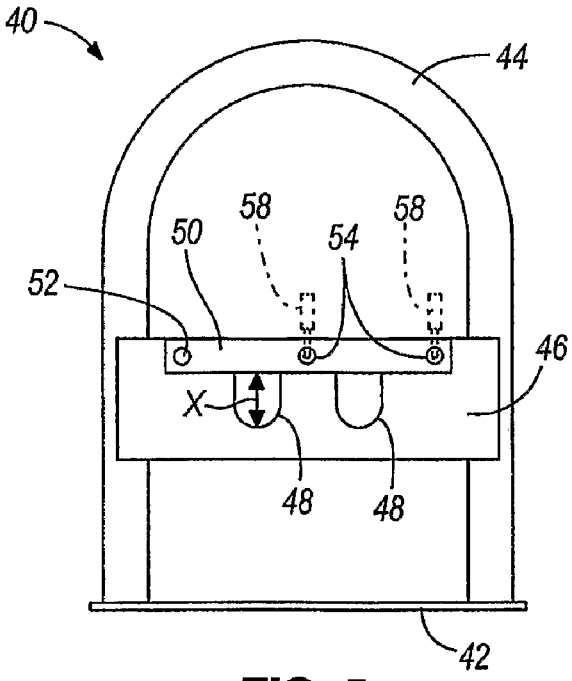
FIG. 5 is a front plan view of the hose storage device of FIG. 1 with the locking bar in a locked position.
Figure 6:
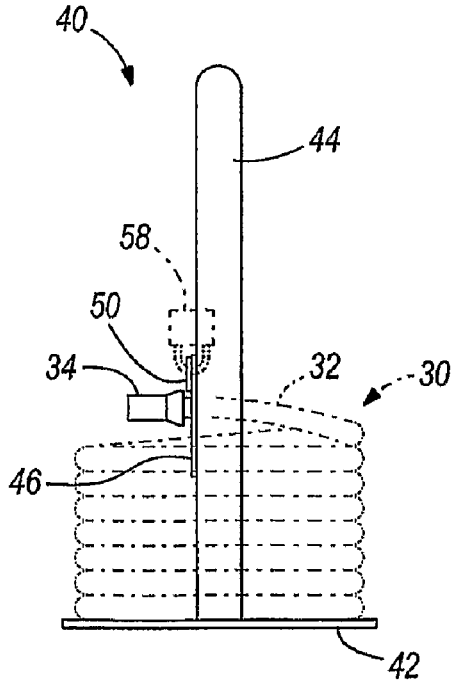
FIG. 6 is a side elevation view of the hose storage device of FIG. 5.

A securing plate 46 is attached to the support post 44. The securing plate 46 has a pair of hose-receiving openings 48. The securing plate 46 has at least one lock-receiving aperture 49. A locking bar 50 is attached to the securing plate 46 for pivotal movement about a pivot 52. The locking bar 50 is moveable between an open position, as shown in FIG. 3, and a closed position, as shown in FIG. 5. The locking bar 50 has at least one lock-receiving aperture 54 configured to align with the lock-receiving aperture 49 of the securing plate 46 when the locking bar 50 is in the closed position. As shown in FIGS. 5 and 6, a pad lock 58 or other suitable lock can be passed through the aligned lock-receiving apertures 49 and 54 in order to lock the locking bar 50 to the securing plate 46.

As shown in FIGS. 2 and 3, each hose-receiving opening 48 has a minimum width Y that is greater than a diameter D of a tube portion 32 of the hose 30, but smaller than a diameter D of end fittings 34 of the hose 30. When the locking bar 50 is in the open position, the tube portion 32 at each end of the hose 30 can be positioned in one of the hose-receiving openings 48. When it is desired to lock the hose 30, the locking bar 50 is pivoted to the closed position shown in FIG. 5. In the closed position, the locking bar 50 closes off each hose-receiving opening 48, such that each hose-receiving opening 48 has a maximum diameter X (as shown in FIG. 5) that is less than the diameter D (as shown in FIG. 2) of the end fittings 34 of the hose 30. Once the locking bar 50 is moved to and secured in the closed position, the hose end fittings 34 are too large to be removed from the hose-receiving openings 48 and the hose 30 is secured within the hose storage device 40. While the securing plate 46 and the locking bar 50 are shown as being attached to the support post 44, the securing plate 46 and the locking bar 50 can alternatively be attached to the base plate 42. As another alternative, the hose-receiving openings 48 can be integrally formed in the base plate 42 and the locking bar 50 can be pivotally attached to the base plate 42 to close the hose-receiving openings 48.

Figure 7:
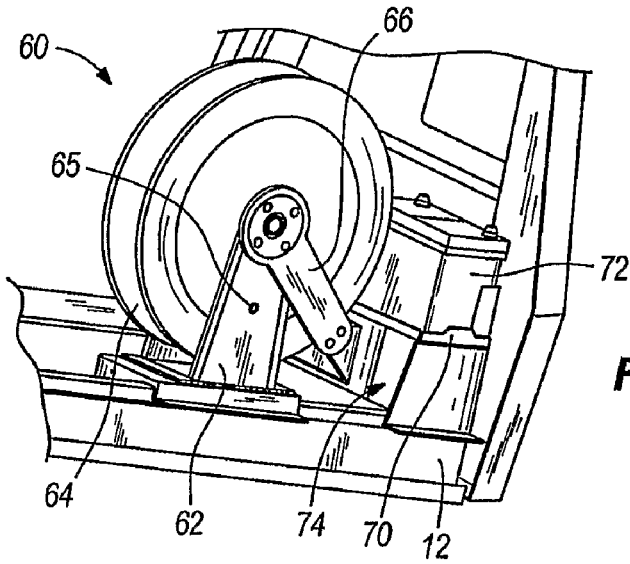
FIG. 7 is a perspective view of a portable compressor with a cover removed and a hose storage device according to another embodiment of the invention.
Figure 8:
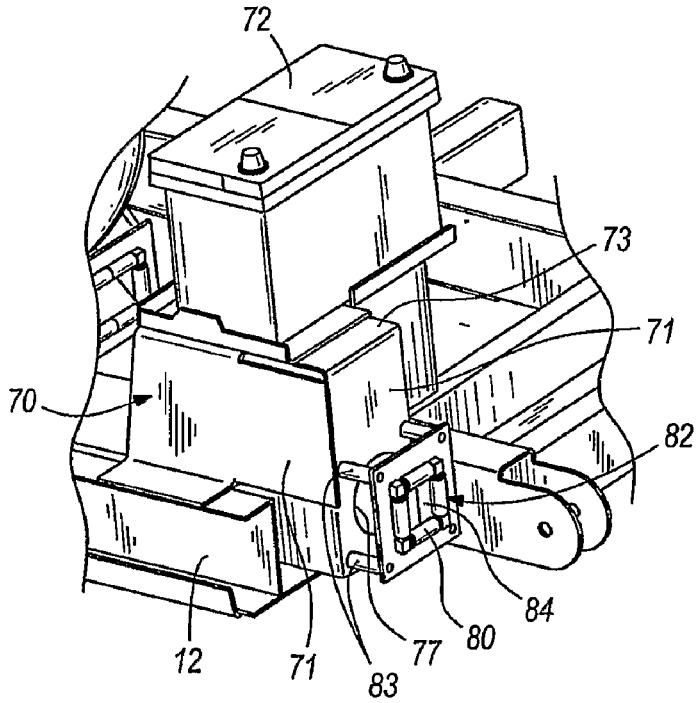
FIG. 8 is a perspective view of the hose passage of a hose storage device of FIG. 7.
Figure 9:
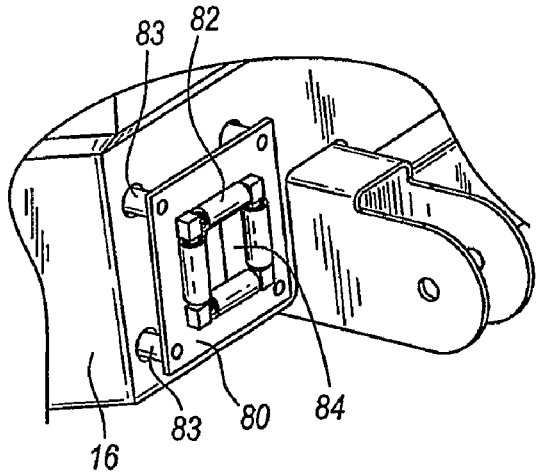
FIG. 9 is a perspective view of the hose port of the hose storage device of FIG. 7.

FIGS. 7-9 illustrate a hose storage device 60 according to another embodiment of the invention. The hose storage device 60 is configured for storing a hose substantially within the housing 16 of the portable compressor 10. FIGS. 7-8 illustrate the portable compressor 10 with the cover 18 removed.

The hose storage device 60 includes a hose reel 64 mounted on a bracket 62 that is attached to the frame structure 12 of the portable compressor 10. In one embodiment, the hose reel 64 is configured such that the hose 30 can be automatically retracted. As shown in FIG. 7, a lock pin 64 may be provided to lock the position of the hose reel 64 when it is desired to prevent extension of the hose 30. As also shown in FIG. 7, a hose guide 66 is provided to direct the path of the hose 30 from the hose reel 64 to a hose passage 74. The hose passage 74 is defined by a battery tray 70 that supports a battery 72 in an elevated position that does not interfere with movement of the hose 30. As shown in FIG. 8, the battery tray 70 has side walls 71 and a top plate 73 to define a clear, unobstructed path from the hose guide 66 to an outlet port 77 through the housing 16 of the portable compressor 10.

As shown in FIGS. 8 and 9, a roller plate 80 aligned with the outlet port 77 is provided outside of the housing 16. In one embodiment, the roller plate 80 is attached to the battery tray 70 via spacers 83. The spacers 83 extend beyond a surface of the housing 16. The roller plate 80 has a hose opening 84 with a plurality of rollers 82 positioned around the hose opening 84. The rollers 82 allow the hose 30 to move smoothly during extension and recoiling. Since the roller plate 80 is connected to the battery tray 70, any forces from the retracting hose 30 are transmitted to the rigid battery tray 70 and the frame structure 12 bypassing the housing 16.

Figure 10:
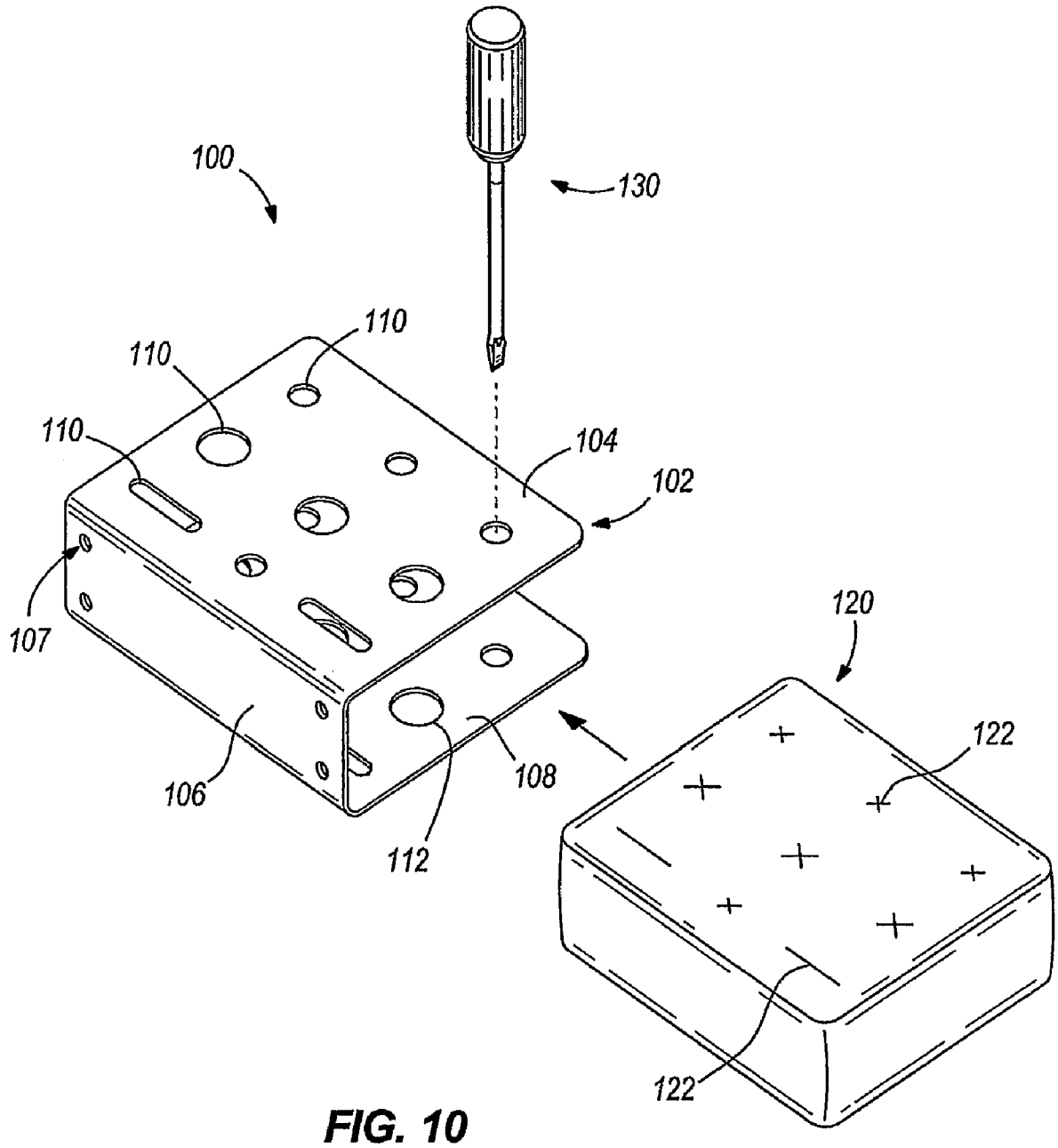
FIG. 10 is an exploded perspective view of a releasable tool storage device according to another embodiment of the invention.

FIG. 10 illustrates a tool storage device 100 according to one embodiment of the invention. The tool storage device 100 includes a support structure 102. In one embodiment, the support structure 102 is manufactured from a sheet of material (e.g., steel, aluminum, plastic, etc.) bent or molded to form a top surface 104, a side surface 106, and a bottom surface 108. Other shapes and materials for the support structure 102 can also be utilizes. The side surface 106 includes mounting holes 107 to facilitate mounting of the support structure 102 to a portion of the portable compressor 10, for example, within the housing 16.

The top and bottom surfaces 104 and 108 include aligned tool-receiving holes 110 and 112, respectively. The tool-receiving holes 110 and 112 can have various shapes and configurations in addition to those shown in FIG. 10. The tool-receiving holes 110 and 112 are configured to receive various tools, for example, hose nozzles, screw drivers, drinking cups, cellular phones, etc. To prevent tools 130 from falling out of the receiving holes 110 and 112, a foam layer 120 is inserted between the top and bottom surfaces 104 and 108. The foam layer 120 includes narrow holes or slits 122 configured to align with the tool-receiving holes 110 and 112 in the top and bottom surfaces 104 and 108. The foam layer 120 can be snugly fit into the support structure 102 or secured within the support structure 102 with an adhesive. The foam layer 120 can be manufactured from any suitable resilient material and can provide a friction force on the tools 130 to prevent the tools 130 from falling out of the support structure 102. In some embodiments, the foam layer 120 is replaceable once the narrow holes or slits 122 are overly worn.

Various features and advantages of the invention are set forth in the following claims.

What is claimed is:

1. A storage device for storing a hose on a portable compressor, the hose having a first end and a second end, the storage device comprising:

a support bar around which the hose can be wrapped when the hose is not in use;

a securing plate coupled to the support bar, the securing plate including two hose-receiving openings, each opening having an open and configured to receiving an opposite end of the hose; and a locking bar pivotably attached to at least one of the securing plate and the support bar, the locking bar pivotable between an opening position in which the hose can be unwrapped from the support bar and a closed position in which the first end and the second end of the hose are locked with respect to the two hose-receiving openings.

2. The storage device of claim 1 and further comprising a base plate coupled to the support bar, the base plate including a plurality of holes that receive fasteners to couple the base plate to a frame of the portable compressor.

3. The storage device of claim 2 wherein the securing plate and the locking bar are coupled to the base plate.

4. The storage device of claim 2 wherein the compressor is located inside a housing supported on the frame and the base plate is coupled to the frame outside of the housing.

5. The storage device of claim 1 wherein the securing plate includes at least one first lock-receiving aperture and the locking bar includes at least one second lock-receiving aperture, the at least one lock-receiving aperture aligning with the at least one second lock-receiving aperture in order to receive a pad lock.

6. The storage device of claim 1 wherein the two hose-receiving openings each have a diameter capable of receiving a tube portion of the hose but not capable of receiving an end fitting of the hose.

7. The storage device of claim 1, wherein the support bar is U-shaped, and defines two ends that are directly connected to a base plate.

8. The storage device of claim 1, wherein the two hose-receiving openings are each U-shaped.

9. The storage device of claim 8, wherein each of the two hose-receiving openings is open at the uppermost edge of the securing plate.

10. The storage device of claim 8, wherein the locking bar pivots from an open position, in which each of the two hose-receiving openings are open, to a closed position, in which each of the two hose-receiving openings are closed.

* * * * *

UNITED STATES PATENT AND TRADEMARK OFFICE

CERTIFICATE OF CORRECTION

PATENT NO. : 7,506,661 B2
APPLICATION NO. : 11/571054
DATED : March 24, 2009
INVENTOR(S) : Christian Corrigan et al.

It is certified that error appears in the above-identified patent and that said Letters Patent is hereby corrected as shown below:

Col. 4 Claim 1, line 55:

change “having an open and configured to receiving an opposite...” to --having an open end configured to receive an opposite...--

Col. 4 Claim 1, line 59:
change “between an opening position...” to --between an open position...--

Signed and Sealed this

Nineteenth Day of May, 2009

JOHN DOLL
*Acting Director of the United States Patent and Trademark Office*